US011585159B2

(12) United States Patent
Nelson et al.

(10) Patent No.: US 11,585,159 B2
(45) Date of Patent: Feb. 21, 2023

(54) INNER DRILLING RISER TIE-BACK INTERNAL CONNECTOR

(71) Applicant: Dril-Quip, Inc., Houston, TX (US)

(72) Inventors: John E. Nelson, Houston, TX (US); Oscar Maldonado, Houston, TX (US); Bruce J. Witwer, Aberdeen (GB)

(73) Assignee: Dril-Quip, Inc., Houston, TX (US)

( * ) Notice: Subject to any disclaimer, the term of this patent is extended or adjusted under 35 U.S.C. 154(b) by 11 days.

(21) Appl. No.: 16/976,972

(22) PCT Filed: Feb. 28, 2019

(86) PCT No.: PCT/US2019/019931
§ 371 (c)(1),
(2) Date: Aug. 31, 2020

(87) PCT Pub. No.: WO2019/169061
PCT Pub. Date: Sep. 6, 2019

(65) Prior Publication Data

US 2021/0002964 A1 Jan. 7, 2021

Related U.S. Application Data

(60) Provisional application No. 62/637,042, filed on Mar. 1, 2018.

(51) Int. Cl.

| | |
|---|---|
| ***E21B 17/01*** | (2006.01) |
| ***E21B 17/02*** | (2006.01) |
| ***E21B 41/00*** | (2006.01) |

(52) U.S. Cl.
CPC ..... *E21B 17/01* (2013.01); *E21B 17/02* (2013.01); *E21B 41/0007* (2013.01)

(58) Field of Classification Search
CPC ..... E21B 17/01; E21B 17/02; E21B 41/0007
USPC ..... 166/367
See application file for complete search history.

(56) References Cited

U.S. PATENT DOCUMENTS

| | | | | |
|---|---|---|---|---|
| 4,696,493 | A | 9/1987 | Brammer | |
| 5,259,459 | A * | 11/1993 | Valka | E21B 33/043 166/359 |
| 5,775,427 | A * | 7/1998 | Skeels | E21B 33/038 166/359 |
| 2011/0155382 | A1 | 6/2011 | Pallini et al. | |
| 2013/0269947 | A1 | 10/2013 | Shilling et al. | |

(Continued)

OTHER PUBLICATIONS

International Search Report and Written Opinion issued in related PCT Application No. PCT/US2019/019931 dated Jun. 7, 2019, 12 pages.

*Primary Examiner* — Matthew R Buck
*Assistant Examiner* — Patrick F Lambe
(74) *Attorney, Agent, or Firm* — Baker Botts L.L.P.

(57) ABSTRACT

Systems and methods for coupling a platform to a subsea wellhead are provided. The systems may include a riser extending between the platform and the subsea wellhead. The systems may further include an inner drilling riser tie-back connector ("ITBC") coupled to an inner riser and having an outer body and an inner body. The inner body is at least partially disposed within the outer body, and the inner body is translatable along a longitudinal axis of the ITBC between a first unlocked position and a second locked position. The systems may additionally include a locking mechanism for the ITBC.

20 Claims, 8 Drawing Sheets

(56) References Cited

U.S. PATENT DOCUMENTS

2015/0176358 A1* 6/2015 Williams ..... E21B 33/038
166/345
2016/0265297 A1* 9/2016 Lyle ..... E21B 17/01

* cited by examiner

INNER DRILLING RISER TIE-BACK INTERNAL CONNECTOR

CROSS-REFERENCE TO RELATED APPLICATION

The present application is a U.S. National Stage Application of International Application No. PCT/US2019/019931 filed Feb. 28, 2019, which claims priority to U.S. Provisional Application Ser. No. 62/637,042 filed on Mar. 1, 2018, both of which are incorporated herein by reference in their entirety for all purposes.

BACKGROUND

The present disclosure relates generally to well risers and, more particularly, to an improved riser tie-back connector.

In drilling or production of an offshore well, a riser may extend between a vessel or platform at the surface and a subsea wellhead. In certain implementations, the riser may couple the subsea wellhead to a Blow-Out-Preventer ("BOP") located at the surface. The riser may be as long as several thousand feet, and may be made up of successive riser sections that are coupled together through one or more riser connections. Riser sections with adjacent ends may be connected on board the vessel or platform as the riser is lowered into position. Auxiliary lines, such as choke, kill, and/or boost lines, may extend along the side of the riser to connect with the wellhead, so that fluids may be circulated downwardly into the wellhead for various purposes. A tie-back connector may be used to couple the riser to the subsea wellhead.

It is often desirable to use a riser which has a small inner diameter in order to facilitate fluid flow at higher pressures. For instance, during drilling operations it may be desirable to use a dual riser with an inner riser section that has a small inner diameter in order to provide a higher pressure capacity and improve the hydraulic circulation of the drilling fluid (mud) from the subsea wellhead to the surface. Stated otherwise, using a riser with a smaller diameter allows the fluids to be directed uphole at a higher velocity and with a higher pressure. In certain implementations, the smaller riser may reside inside a larger, lower pressure rated riser. It is therefore desirable to develop a tie-back connector that can couple a small diameter riser to a subsea wellhead.

BRIEF DESCRIPTION OF THE DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well risers and, more particularly, to systems and methods for riser coupling.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

The term "platform" as used herein encompasses a vessel or any other suitable component located on or close to the surface of the body of water in which a subsea wellhead is disposed. The terms "couple" or "couples," as used herein are intended to mean either an indirect or a direct connection. Thus, if a first device couples to a second device, that connection may be through a direct connection, or through an indirect (electrical and/or mechanical) connection via other devices and connections. The term "uphole" as used herein means along the drillstring or the hole from the distal end towards the surface, and "downhole" as used herein means along the drillstring or the hole from the surface towards the distal end. It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface.

Figure 1:
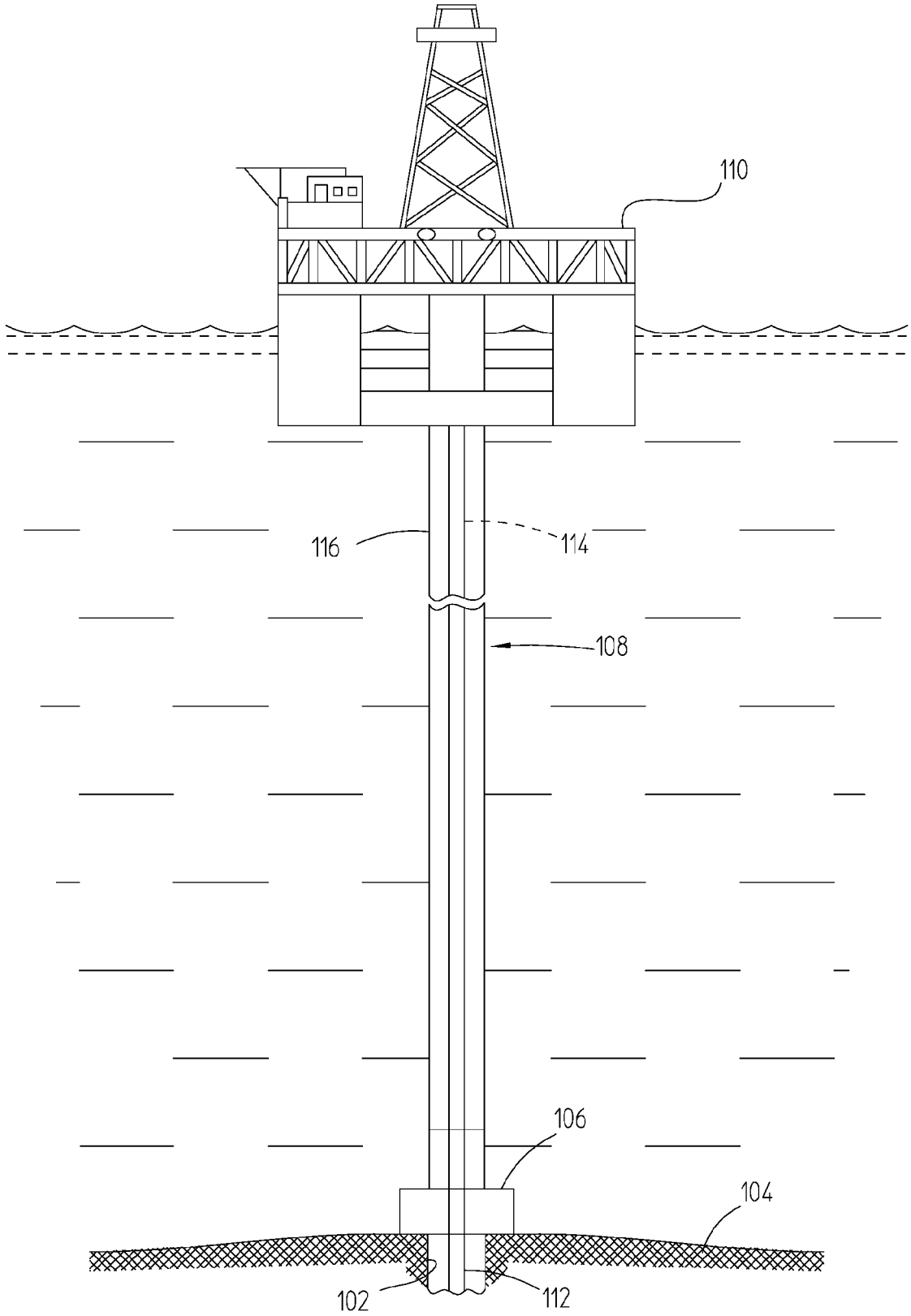
FIG. 1 depicts a system for performance of subsea well operations, in accordance with an embodiment of the present disclosure.

FIG. 1 depicts an illustrative system for performing subsea subterranean operations. In certain illustrative implementations, a wellbore 102 may be drilled into a subterranean formation 104. A wellhead 106 may be placed on the sea floor at an uphole terminal end of the wellbore 102. A riser 108 may fluidically couple the wellhead 106 to a platform 110 to facilitate fluid flow between the wellhead 106 and the platform 110. Specifically, as shown in FIG. 1, a first terminal end of the riser 108 may be coupled to the platform and a second terminal end of the riser 108 may be coupled to the wellhead 106. A production pipe or a drilling pipe 112 may be inserted into the wellbore 102. Accordingly, fluids may flow between the platform 110 and the subterranean formation 104 through the riser 108, the wellhead 106 and the production pipe or the drilling pipe 112 disposed therein.

It is desirable to provide a fluid flow path between the subterranean formation 104 and the platform 110 that permits efficient fluid flow between the two. In accordance with an illustrative embodiment of the present disclosure which is discussed in further detail below, the riser 108 may include an inner riser pipe 114 which is installed inside an outer riser pipe 116. The term "inner riser pipe" as used herein refers to a riser pipe with an outer diameter that is less than the inner diameter of the outer riser pipe 116. The term "outer riser pipe" as used herein refers to a riser pipe with an inner diameter that is greater than the outer diameter of the inner riser pipe 114. In order to facilitate the installation of the inner riser pipe 114 inside the outer riser pipe 116, an Inner Drilling Riser Tie-Back Connector (hereinafter "ITBC") is installed at the wellhead 106. The structure and operation of the ITBC is discussed in further detail in conjunction with FIGS. 2A, 2B, 3A, 3B, 4A, and 4B.

Figure 2A:
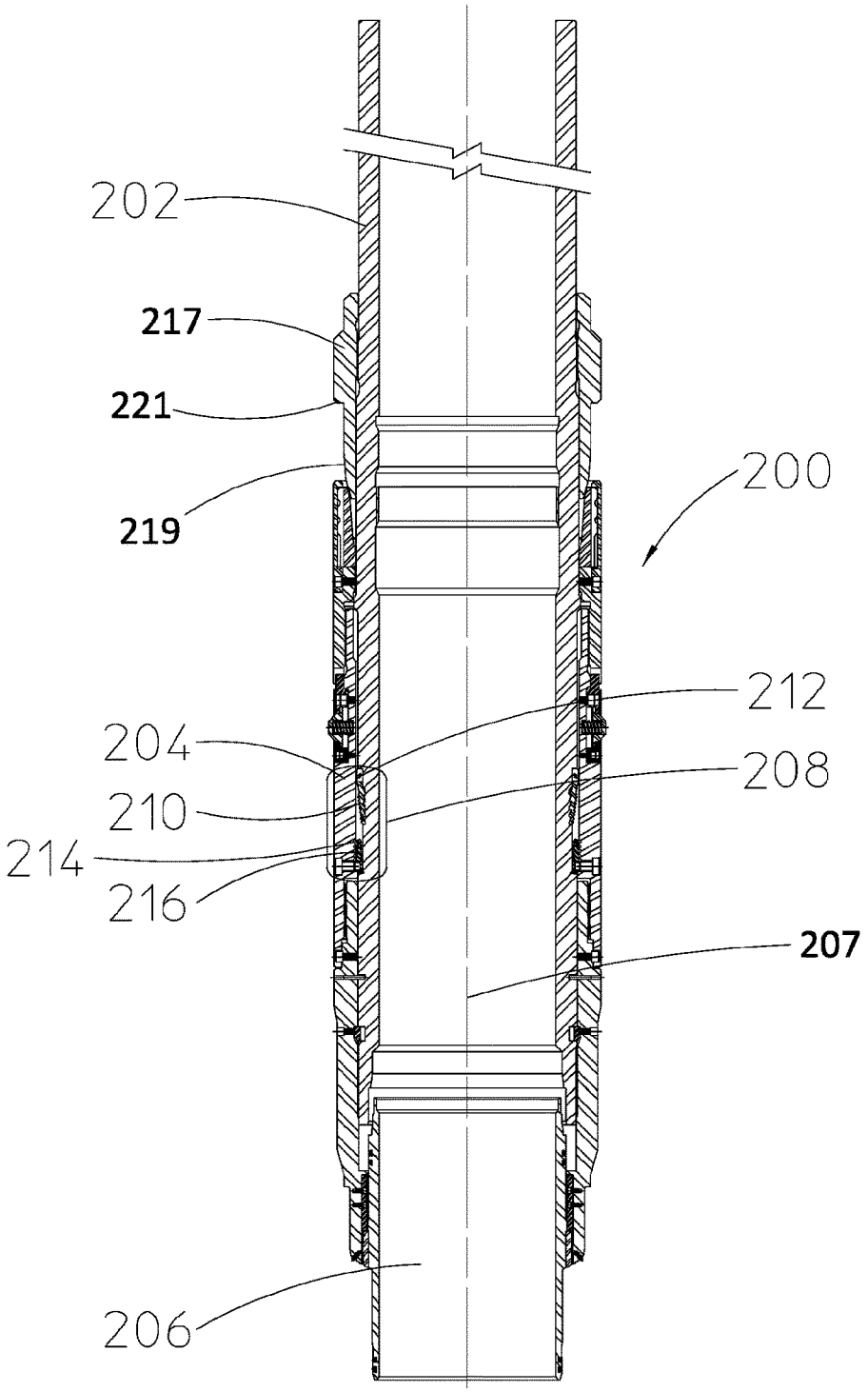
FIG. 2A is a partial cutaway view of an inner drilling riser tie-back connector unlocked and not fully landed within a subsea wellhead, in accordance with an embodiment of the present disclosure.
Figure 2B:
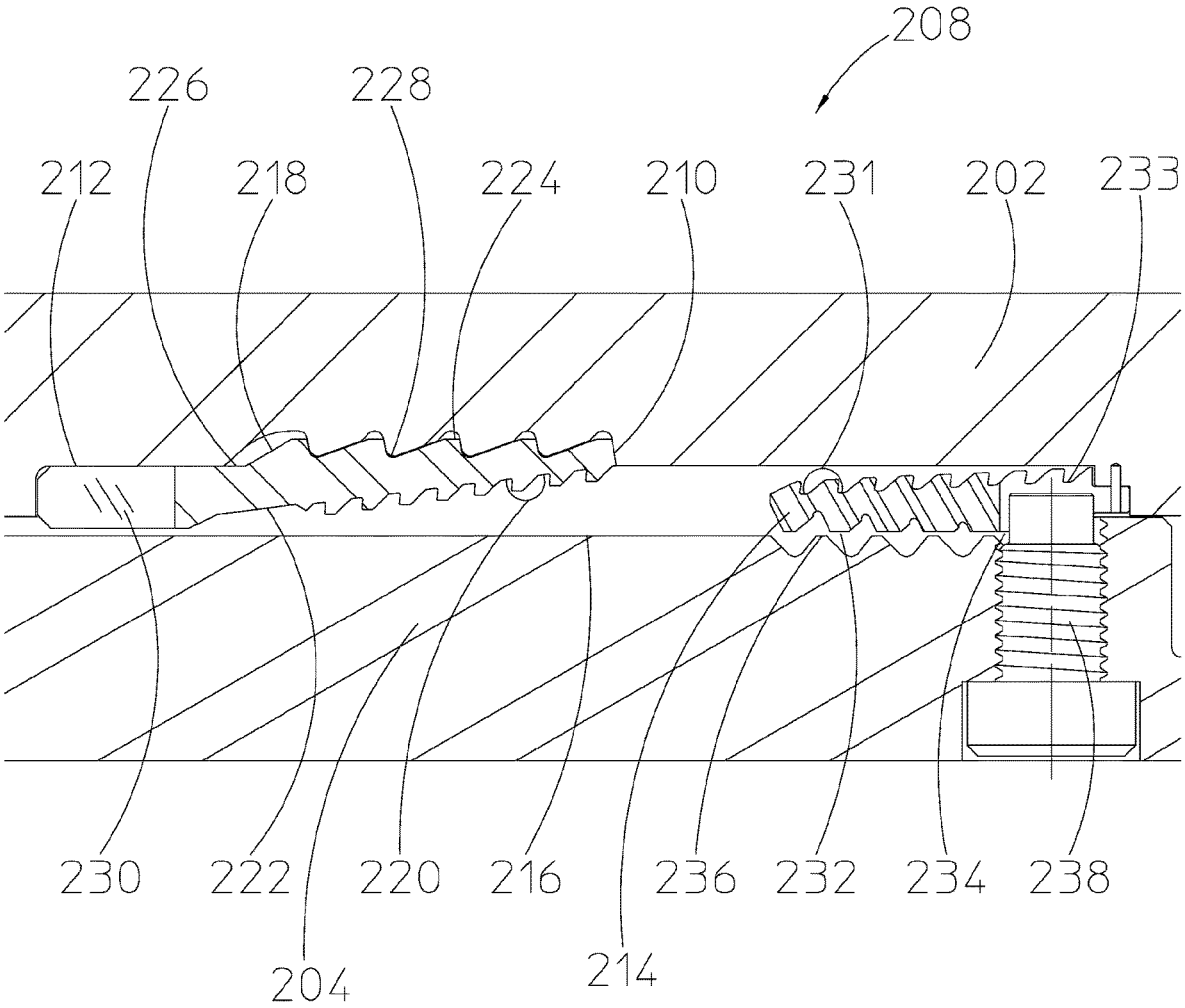
FIG. 2B is a close-up partial cutaway view of a locking assembly of the inner drilling riser tie-back connector of FIG. 2A in an unlocked position, in accordance with an embodiment of the present disclosure.
Figure 3A:
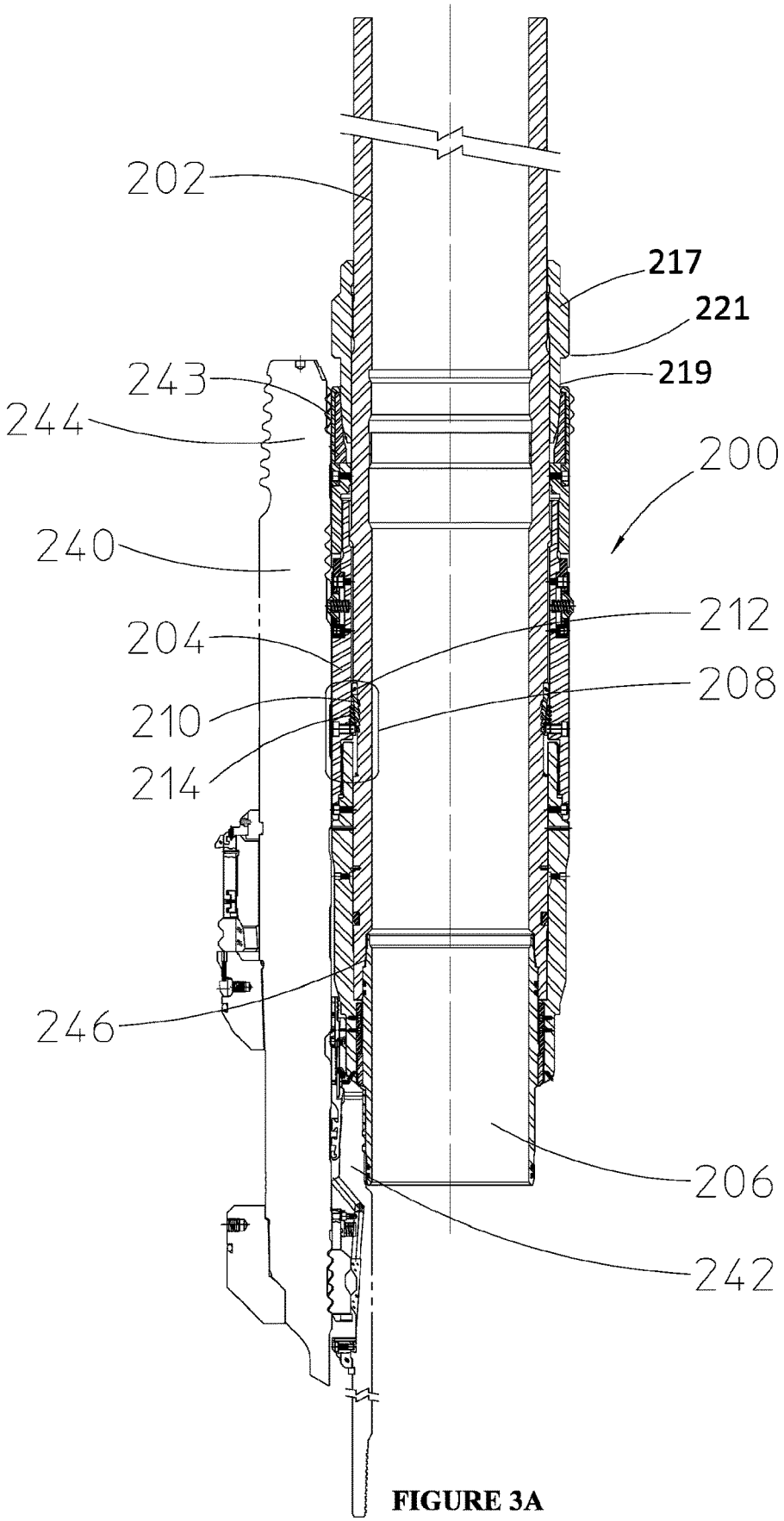
FIG. 3A is a partial cutaway view of the inner drilling riser tie-back connector of FIG. 2A locked and fully landed within a subsea wellhead, in accordance with an embodiment of the present disclosure.
Figure 3B:
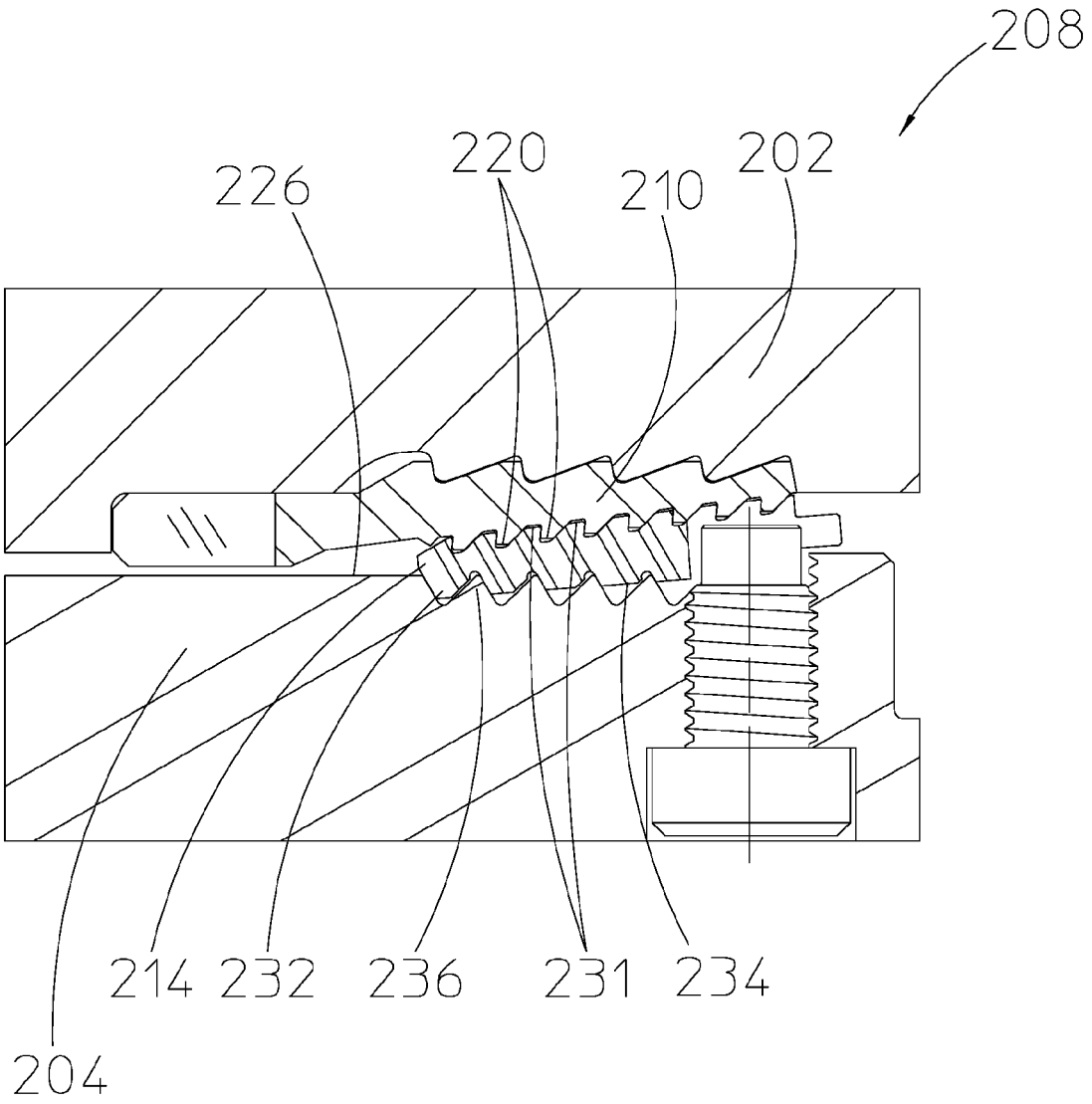
FIG. 3B is a close-up partial cutaway view of a locking assembly of the inner drilling riser tie-back connector of FIG. 3A in a locked position, in accordance with an embodiment of the present disclosure.

FIGS. 2A, 2B, 3A, and 3B depict an ITBC in accordance with an illustrative embodiment of the present disclosure which is denoted generally with reference numeral 200. Specifically, FIGS. 2A and 2B show the ITBC 200 in a first unlocked or "running" configuration before the ITBC is properly installed at a wellhead. In contrast, FIGS. 3A and 3B show the ITBC 200 in a second position fully locked to the subsea wellhead and with a seal activated.

Turning first to FIG. 2A, the ITBC 200 may include an inner body 202 and an outer body 204. The ITBC 200 may include a lower sub 206 coupled to a lower end of the outer body 204. This lower sub 206 may be landed in and sealed against a casing hanger, a tubing hanger, or some other component within the wellhead. Downward movement of the inner body 202 with respect to the outer body 204 and lower sub 206 may energize a seal between the inner body 202 and the lower sub 206. This provides a fluid tight seal between the inner riser and casing/production tubing located below the wellhead.

The inner body 202 may be coupled to an inner riser pipe (not shown) at an upper end of the inner body 202 via one or more riser connections (e.g., a threaded connection). In certain implementations, the ITBC 200 may extend approximately 15-20 feet above a subsea wellhead (not shown) where it may be coupled to the inner riser pipe via the riser connections. This extension of the ITBC 200 above the subsea wellhead may help to reduce fatigue on the ITBC 200.

The inner body 202 and the outer body 204 may generally include tubular bodies having hollow interiors. The inner body 202 may generally have an outer diameter that is slightly smaller than an inner diameter of the outer body 204 such that the inner body 202 may be at least partially disposed within the outer body 204. Moreover, the ITBC 200 may be operable between a first and a second position as discussed above. The inner body 202 may be configured to move axially through the outer body 204 along a longitudinal axis 207 between a first unlocked position (FIGS. 2A and 2B) and a second locked position (FIGS. 3A and 3B).

The ITBC 200 may include a locking assembly 208 depicted in the first unlocked or unengaged position in FIG. 2A. This first unlocked position may be referred to as the "running" position as it enables the ITBC 200 to be run into an appropriate position for installation in a subsea wellhead. The locking assembly 208 may generally include a first threaded ring 210 disposed about an outer circumference 212 of the inner body 202 and a second threaded ring 214 disposed along an inner circumference 216 of the outer body 204. As discussed in detail below, the second threaded ring 214 may be a collet ring.

In addition to the components discussed above, the ITBC 200 may include a setting component 217 coupled directly to the inner body 202. The setting component 217 may be attached, e.g., via a threaded connection, to the radially outer circumference 212 of the inner body 202 at an axial position above the outer body 204. The setting component 217 may have a generally cylindrical body with a frustoconical radially outer surface 219 at a lower end thereof. The frustoconical radially outer surface 219 slopes in a radially outward direction as it moves from bottom to top of the lower end. The setting component 217 may also include a stop shoulder 221 extending radially outward from the setting component 217 at an axial position above the frustoconical radially outer surface 219.

Referring now to FIG. 2B, an expanded view of locking assembly 208 of the ITBC 200 is depicted. The first threaded ring 210 may include a generally ring-shaped body 218 disposed about the outer circumference 212 of the inner body 202. The first threaded ring 210 generally includes a series of threads 220 disposed along an outer circumference 222 of the body 218. In certain embodiments, the first threaded ring 210 may be a separate standalone ring having an alternating series of teeth 224 disposed along an inner circumference 226 of the body 218 as well. The inner body 202 may include a corresponding and complementary alternating series of teeth 228 disposed along the outer circumference 212 of the inner body 202 and used to properly position the first threaded ring 210 longitudinally along the inner body 202.

As illustrated, the inner circumference 226 of the first threaded ring 210 may extend in a generally axial direction (e.g., parallel to the longitudinal axis of the ITBC). The series of teeth 224 may extend radially inward from the inner circumference 226 such that the teeth 224 are received into the complementary teeth 228 on the outer circumference 212 of the inner body 202. The first threaded ring 210 is seated within this portion of the inner body 202 via the engagement of the teeth 224 and 228. In some embodiments, the first threaded ring 210 may be a lock ring that is biased in a radially inward direction. To that end, the first threaded ring 210 may not be a continuous ring extending around the entire outer circumference 212 of the inner body 202. Instead, the first threaded ring 210 has a break formed therein at a circumferential position that allows the ring 210 to flex in a radial direction. The first threaded ring 210 is biased radially inward into engagement with the teeth 228 of the inner body 202 during initial installation of the ITBC.

As illustrated, the outer circumference 222 of the first threaded ring 210 may have a frustoconical shape that moves in a radially inward direction from an upper end of the first threaded ring 210 to a lower end of the first threaded ring 210. As such, the first threaded ring 210 has a greater radial wall thickness at an upper end thereof than at the opposing lower end thereof. The series of threads 220 on the outer circumference 222 of the first threaded ring 210 are angled with respect to the frustoconical radially outer wall. The threads 220 are positioned at the same angle with respect to the frustoconical wall as corresponding threads 231 of the second threaded ring 214 are angled with respect to an inner circumference 233 of the second threaded ring 214. The angled threads allow the first threaded ring 210 to ratchet over the second threaded ring 214, as described in greater detail below.

Figure 5:
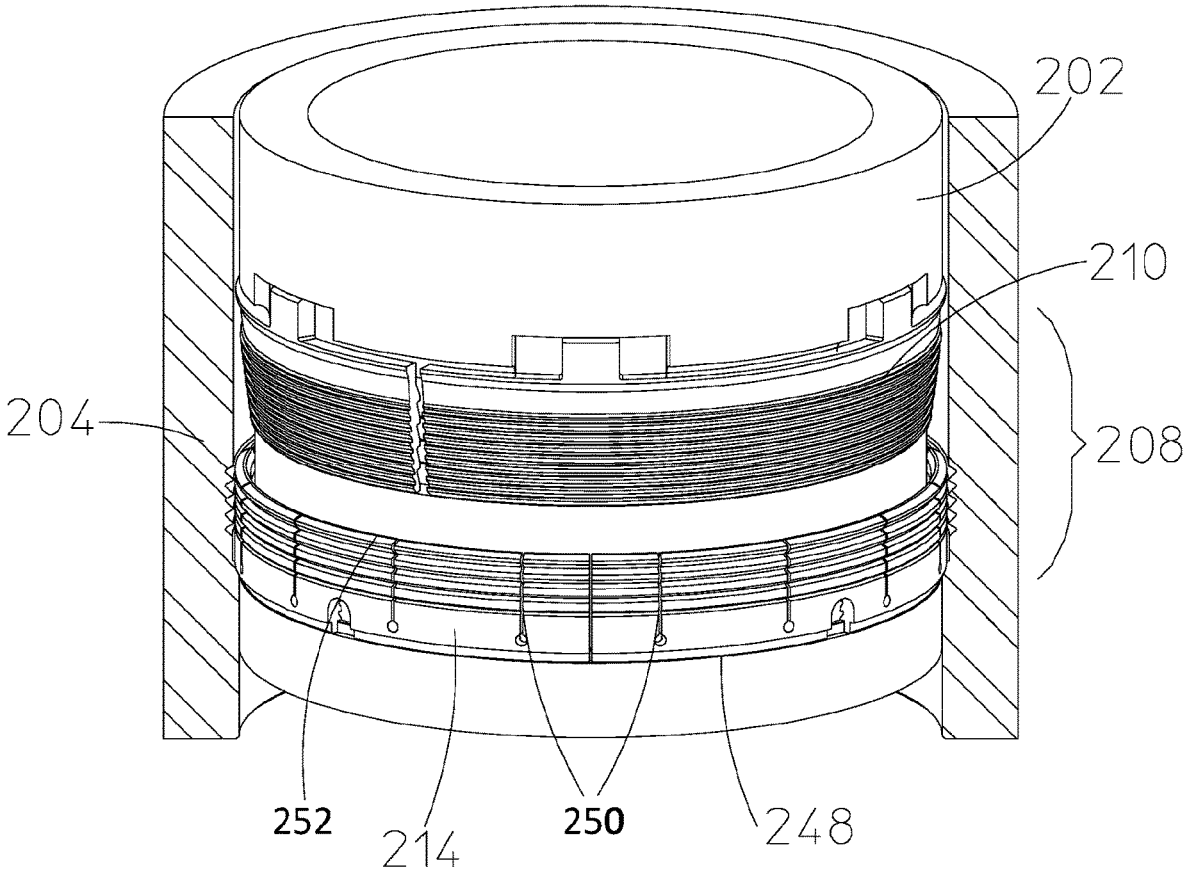
FIG. 5 is a perspective view of a locking mechanism for use in the locking assembly of FIGS. 2A, 2B, 3A, and 3B, in accordance with an embodiment of the present disclosure.

The first threaded ring 210 may also be held in place along the inner body 202 by one or more longitudinal protrusions 230. The longitudinal protrusions 230 do not extend about an entire circumference of the first threaded ring 210, but instead are intermittently disposed at an upper end of the first threaded ring 210. The longitudinal protrusions 230 extend in an axial direction (e.g., parallel to the longitudinal axis of the ITBC) from the ring-shaped body 218 of the first threaded ring 210 and are received into corresponding slots formed into a radially outer edge of the inner body 202, as shown in FIG. 5. The longitudinal protrusion(s) prevent the first threaded ring 210 from rotating with respect to the inner body 202. That way, rotation of the inner body 202 about the longitudinal axis also causes an equivalent rotation of the first threaded ring 210.

The second threaded ring 214 includes a series of threads 231 disposed along an inner circumference 233 of the second threaded ring 214. As mentioned above, the threads 231 on the second threaded ring 214 are generally the same size as and disposed at the same angle with respect to the inner circumference 233 of the second threaded ring 214 as the corresponding threads 220 on the first threaded ring 210. The second threaded ring 214 may further include a series of alternating teeth 232 extending along an outer circumference 234 of the second threaded ring 214. To interface with these alternating teeth 232, the outer body 204 includes a series of corresponding and complementary alternating teeth 236 extending along the inner circumference 216 of the outer body 204.

In the illustrated unlocked position of FIG. 2B, the second threaded ring 214 is oriented in a generally straight axial direction (e.g., parallel to the longitudinal axis of the ITBC) from a lower fixed end to an opposing upwardly extended end. The lower fixed end is directly coupled to the outer body 204 while the upwardly extended end is a free end cantilevered from the fixed end. As such, the second threaded ring 214 may function as a collet ring. As depicted, the second threaded ring 214 may be attached at the fixed end to the outer body 204 using one or more pins 238.

As illustrated, each of the teeth 236 extending along the inner circumference 216 of the outer body 204 are generally the same size. The teeth 232 on the outer circumference 234 of the second threaded ring 214, however, may each be different sizes (extending to different depths in the threaded ring 214) designed to engage with a corresponding one of the same-size teeth 236 on the outer body 204. When the assembly is locked, the different sized teeth 232 of the second threaded ring 214 are able to fully engage the teeth 236 on the outer body 204 as the second threaded ring 214 is rotated or flexed radially outward from the fixed end into gradually increasing contact with the teeth 236.

Turning now to FIG. 3A, the ITBC 200 is shown in a second locked position. The ITBC 200 is shown disposed within a subsea wellhead 240. It should be noted that only one half of a cross section of the subsea wellhead 240 is illustrated in FIG. 3A. One skilled in the art would understand that the subsea wellhead 240 is a generally cylindrical component that extends circumferentially around the entire ITBC 200, even though this is not explicitly illustrated in the figure. The ITBC 200 is lowered into a large inner bore of the subsea wellhead 240 and is there attached to the wellhead 240 and any other desired components (e.g., casing hanger 242, etc.).

The ITBC 200 may be directed down through the bore of the wellhead 240 until it contacts the casing hanger 242. A downward force may then be applied to the inner body 202. Any suitable mechanism known to one of ordinary skill in the art may be used to apply this downward force to the inner body 202. For instance, in certain illustrative embodiments, the downward force may be applied by the weight of the riser assembly above the ITBC 200.

As the inner body 202 moves downward, the setting component 217 moves down with the inner body 202 such that the frustoconical radially outer surface 219 at the lower end of the setting component 217 pushes radially outward on an upper portion of the outer body 204. This movement of the upper portion of the outer body 204 in a radially outer direction forces a plurality of locking teeth 243 of the outer body 204 in a radially outward direction into engagement with a complementary portion 244 of the subsea wellhead 240. This locks the outer body 204 of the ITBC 200 into position within the subsea wellhead 240.

After setting the outer body 204 in the wellhead 240, additional downward force is applied to the inner body 202. This force moves the inner body 202 downward with respect to the outer body 204 until the locking assembly 208 engages and locks the ITBC 200. Once the ITBC 200 is locked, the locking assembly 208 prevents the inner body 202 from being pulled uphole. To lock the assembly, the first threaded ring 210 slides axially downward and engages the second threaded ring 214 on the outer body 204.

Turning now to FIG. 3B, the threads 220 of the first threaded ring 210 ratchet downward over the corresponding threads 231 of the second threaded ring 214. During this ratcheting, the frustoconical shape of the first threaded ring 210 forces the second threaded ring 214 to flex radially outward from the fixed end (e.g., functioning as a collet) until the teeth 232 of the second threaded ring 214 are initially engaged with the teeth 236 on the outer body 204. These teeth 232, however, are not yet fully aligned with and locked against the corresponding teeth 236 on the outer body 204. To reach this full locking engagement, the first threaded ring 210 is rotated with respect to the second threaded ring 214. That is, after the first threaded ring 210 has ratcheted all the way down the second threaded ring 214, the inner body 202 and attached first threaded ring 210 will be rotated (e.g., via left-hand turns) with respect to the outer body 204 and attached second threaded ring 214. Since the threaded rings 210 and 214 are engaged at this point, the rotation will cause the threaded ring 210 to ride further down the threads of the second threaded ring 214, thereby pushing the second threaded ring 214 still further in a radially outward direction to fully engage and lock against the teeth 236 of the outer body 204.

Turning back to FIG. 3A, the ITBC 200 may further include a seal 246 for establishing a fluid tight seal between the inner body 202 of the ITBC 200 and the lower sub 206 (along with the connected casing/production flowline below). The seal 246 may be any seal known in the art including, but not limited to, a bump seal, a metal-to-metal seal, or an elastomeric seal. In certain embodiments, seal 246 may include multiple individual seals used in combination. The ITBC 200 is configured such that the seal 246 is not fully energized until the first threaded ring 210 has been rotated with respect to the second threaded ring 214 to fully lock the ITBC 200.

Referring again to FIG. 3B, an expanded view of the locking assembly 208 is depicted. As the inner body 202 is moved downward, the threads 220 of the first threaded ring 210 ratchet along and engage with the corresponding threads 231 of the second threaded ring 214. The second threaded ring 214 is pushed radially outward such that the teeth 232 of the second threaded ring 214 are pushed into engagement with the teeth 236 of the outer body 204. Once the downward force pushes inner body 202 down to its final axial position, the inner body 202 may be rotated to fully engage the threads 220 of the first threaded ring 210 with the threads 231 of the second threaded ring 214. This rotation may also be used to fully energize the seal 246 located between the inner body 202 and the lower sub 206 of the ITBC 200.

Figure 4A:
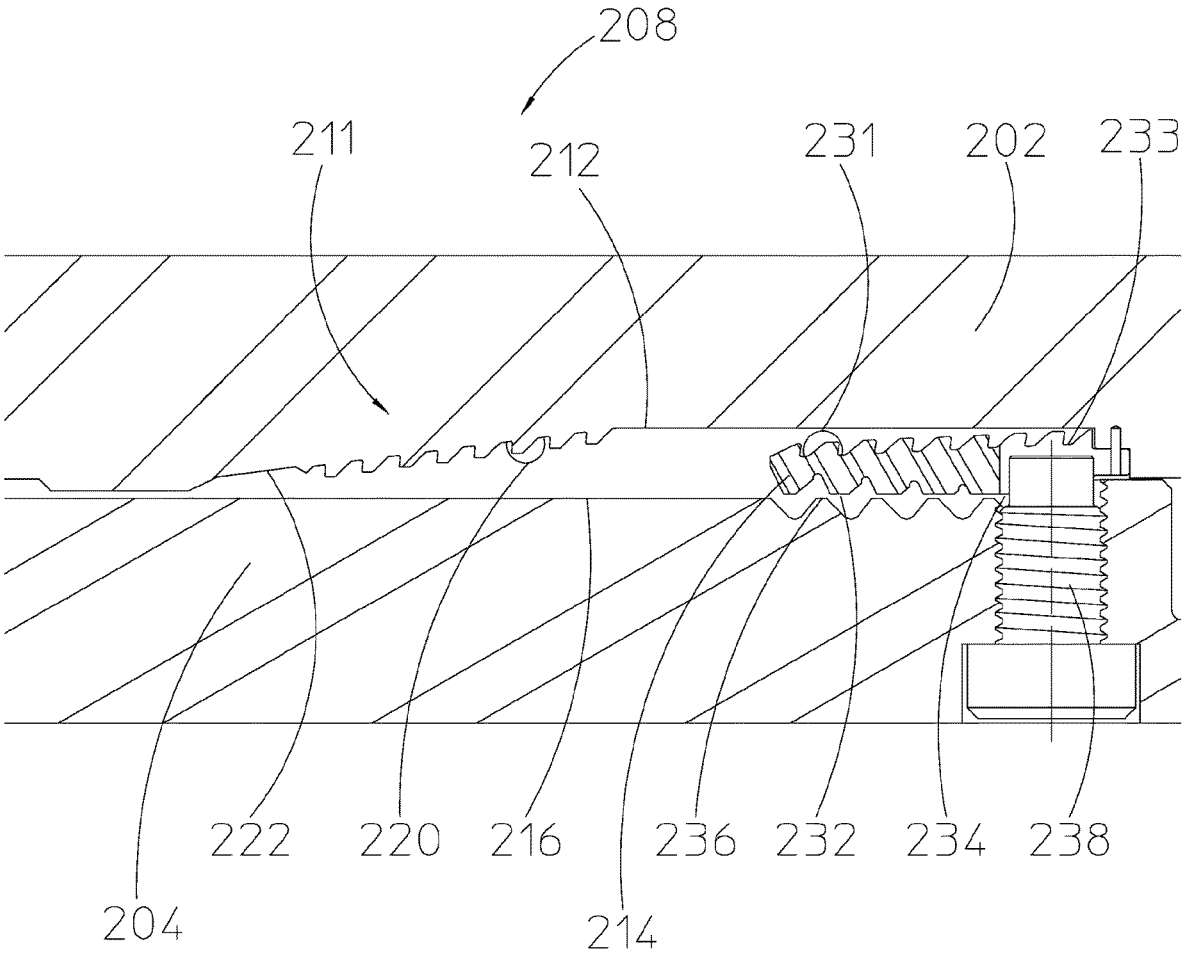
FIG. 4A is a close-up partial cutaway view of a locking assembly of an inner drilling riser tie-back connector in an unlocked position, in accordance with an embodiment of the present disclosure.
Figure 4B:
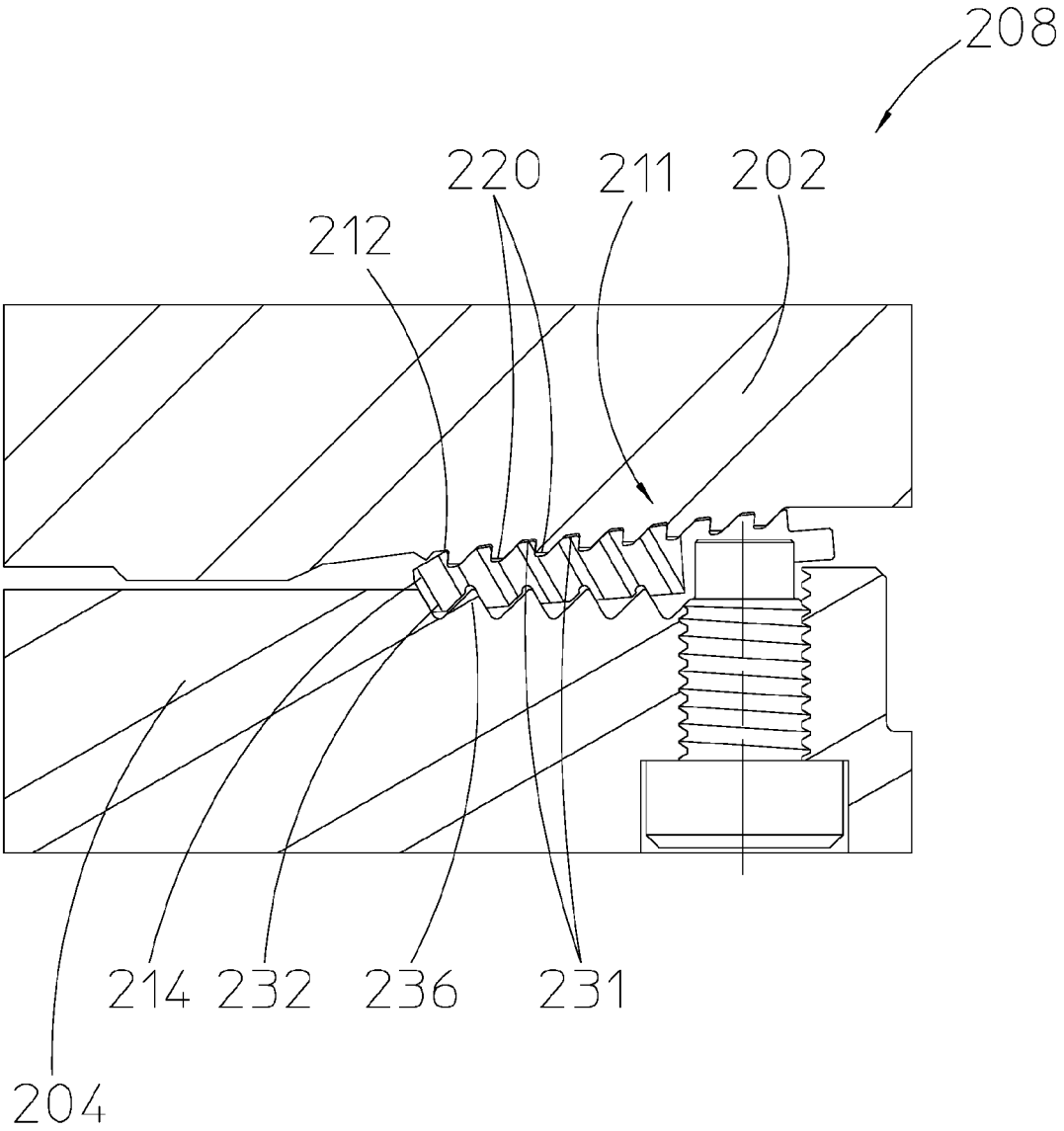
FIG. 4B is a close-up partial cutaway view of the locking assembly of FIG. 4A in a locked position, in accordance with an embodiment of the present disclosure.

Although the first threaded ring 210 of the locking assembly 208 is depicted as a separate, standalone ring in FIGS. 2B and 3B, it should be noted that in other embodiments the first threaded ring 210 may instead be fully integrated with the inner body 202 of the ITBC 200. FIGS. 4A and 4B illustrate such an embodiment of the locking assembly 208. As shown, the first threaded ring 210 may be integrally formed with the inner body 202. That is, instead of being a separate standalone threaded ring, the first threaded ring 210 may include simply a first threaded portion 211 of the inner body 202 of the ITBC 200.

FIG. 4A provides an expanded view of the locking assembly 208 having such an integrally formed first threaded portion 211. The first threaded portion 211 generally includes a series of threads 220 disposed along the outer circumference 212 of inner body 202. Similar to the first threaded ring 210 discussed above, the first threaded portion 211 may include a frustoconical shaped radially external wall that functions to flex the second threaded ring 214 in a radially outward direction to engage the outer body 204 via interlocking teeth. Again, once the first threaded portion 211 has been ratcheted down along the second threaded ring 214, rotation of the inner body 202 causes rotation of the first threaded portion 211 to finalize the locking and sealing connection of the ITBC.

Referring now to FIG. 4B, an expanded view of the locking mechanism 208 in a locked position is depicted with an integrally formed first threaded portion 211. As the inner body 202 slides downward, the threads 220 of the first threaded portion 211 ratchet along and engage with the threads 231 of the second threaded ring 214. The second threaded ring 214 is pushed outward and the teeth 232 of the second threaded ring 214 are pushed into engagement with the teeth 236 of the outer body 204. Once the downward force pushes the inner body 202 down to its final position, the inner body 202 may be rotated to fully engage the threads 220 of the first threaded portion 211 with the threads 231 of the second threaded ring 214. This rotation may also be used to fully engage the seal 246 between the inner body 202 and the lower sub 206.

Referring now to FIG. 5, a perspective view of the locking assembly 208 is depicted in the first unlocked position. In the depicted embodiment, the second threaded ring 214 is attached to the outer body 204 using one or more pins (not presently shown) to provide a fixed end 248. The pins hold the fixed end 248 of second threaded ring 214 in place. As the first threaded ring 210 moves downward and is received by the second threaded ring 214, the first threaded ring 210 pushes the second threaded ring 214 radially outward, causing the second threaded ring 214 to bend or pivot radially outward from the fixed end 248. According to other embodiments, second threaded ring 214 may not be fixedly attached to the outer body 204.

As illustrated, the second threaded ring 214 may include one or more grooves 250 extending from a top edge 252 of the second threaded ring 214 toward the fixed end 248 of the second threaded ring 214. The one or more grooves 250 may be disposed equidistant from each other along the circumference of the second threaded ring 214. The grooves 250 may provide additional flexibility to the second threaded ring 214, enabling the second threaded ring 214 to expand radially outwardly in response to the first threaded ring 210 moving downward along the second threaded ring 214.

In certain implementations, the ITBC 200 may be reusable. Specifically, the ITBC 200 may be landed in the subsea wellhead and used to fluidically couple the inner riser pipe to a production, casing, or drilling pipe below. The ITBC 200 may then be released or disengaged from the subsea wellhead (212, 240) by turning the inner body 202 in a direction that unscrews the locking assembly 208. In one embodiment, a clockwise movement of the inner body 202 may be used to disengage the locking assembly 208. The operator may then disengage the ITBC 200 and lift it in order to land the ITBC 200 a second time if necessary.

In accordance with certain embodiments of the present disclosure, the locking assembly 208 is designed to withstand both tension loads and compression loads applied by the inner riser pipe. Specifically, once the ITBC 200 is installed in place, the inner riser pipe will be under tension. The locking assembly 208 ensures that the inner riser pipe can withstand that tension. Moreover, occurrence of certain events downhole such as, for example, a blow out, can further increase the load on the locking assembly 208, both in tension and compression. Therefore, the locking assembly 208 may be designed to withstand a force of approximately 2 million lbs. The locking assembly 208 may be made from any suitable materials known to those of ordinary skill in the art, including, but not limited to, steel.

Accordingly, an ITBC 200 in accordance with an illustrative embodiment of the present disclosure allows wellbores to be drilled deeper without having to remove the lower pressure riser. Moreover, a low-pressure riser implemented in accordance with embodiments of the present disclosure operates as a second barrier to the environment while the inner riser pipe and the attached ITBC 200 are installed.

In addition, the methods and systems disclosed herein improve the hydraulic flow of drilling fluids by circulating fluids through a smaller inner riser pipe. Further, the disclosed methods and systems add structural strength to the drilling riser system as the strength of the low pressure outer riser pipe and the high pressure inner riser pipe are cumulative.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A system for coupling a platform to a subsea wellhead comprising:

a riser extending between the platform and the subsea wellhead, wherein the riser comprises an inner riser and an outer riser; and an inner drilling riser tie-back connector (ITBC) coupled to the inner riser, wherein the ITBC comprises:

an outer body;

an inner body at least partially disposed within the outer body, wherein the inner body is translatable with respect to the outer body along a longitudinal axis of the ITBC between a first unlocked position and a second locked position; and a locking mechanism comprising a first threaded ring disposed about an outer circumference of the inner body and a second threaded ring disposed along an inner circumference of the outer body, wherein the second threaded ring comprises a series of teeth extending along an outer circumference of the second threaded ring and the outer body comprises a series of corresponding and complementary alternating teeth extending along an inner circumference of the outer body.

2. The system of claim 1, wherein in the first unlocked position the first threaded ring and second threaded ring are not engaged.

3. The system of claim 1, wherein in the second locked position the first threaded ring and the second threaded ring are engaged and the series of teeth extending along the outer circumference of the second threaded ring and the corresponding and complementary teeth extending along the inner circumference of the outer body are engaged.

4. The system of claim 1, wherein the first threaded ring comprises a ring that is separate from the inner body, wherein the first threaded ring comprises a series of teeth extending along an inner circumference thereof, and wherein the inner body comprises a series of corresponding and complementary teeth extending along an outer circumference thereof.

5. The system of claim 4, wherein the first threaded ring further comprises one or more longitudinal protrusions extending in an axial direction from a ring-shaped body of the first threaded ring, the one or more longitudinal protrusions being received into corresponding slots formed into the outer circumference of the inner body.

6. The system of claim 1, wherein the first threaded ring is integrally formed with the inner body.

7. The system of claim 1, wherein an outer circumference of the first threaded ring has a frustoconical shape that slopes in a radially inward direction from an upper end to a lower end of the first threaded ring.

8. The system of claim 1, wherein the second threaded ring further comprises a fixed pivot at a lower end thereof and one or more grooves extending from an upper end thereof opposite the lower end.

9. The system of claim 1, further comprising:

a lower sub coupled to a lower end of the outer body; and a seal element coupled to the inner body for establishing at least a partially fluid tight seal between the inner body and the lower sub.

10. A method of coupling a subsea wellhead to a platform, comprising:

coupling a first terminal end of a riser to the platform and a second terminal end of the riser to the subsea wellhead, the riser comprising an inner riser and an outer riser;

coupling the second terminal end of the inner riser to an inner drilling riser tie-back connector (ITBC) having an outer body and an inner body at least partially disposed within the outer body;

landing and locking the outer body of the ITBC within the subsea wellhead; and applying a downward weight to the inner body to at least partially actuate a locking mechanism of the ITBC, wherein applying the downward weight to the inner body translates the inner body with respect to the outer body along a longitudinal axis of the ITBC from a first unlocked position to a second locked position.

11. The method of claim 10, wherein the locking mechanism comprises a first threaded ring disposed about an outer circumference of the inner body and a second threaded ring disposed along an inner circumference of the outer body, wherein the second threaded ring comprises a series of teeth extending along an outer circumference of the second threaded ring and the outer body comprises a series of corresponding and complementary teeth extending along an inner circumference of the outer body.

12. The method of claim 11, wherein translating the first threaded ring from a first unlocked position to a second locked position ratchets the first threaded ring over the second threaded ring and flexes the second threaded ring in a radially outward direction so the teeth on the second threaded ring engage with the corresponding and complementary teeth on the inner circumference of the outer body.

13. The method of claim 12, further comprising maintaining a lower end of the second threaded ring in a fixed position against the outer body of the ITBC.

14. The method of claim 11, further comprising:

after applying the downward weight to the inner body, rotating the inner body relative to the outer body to fully lock the ITBC to the wellhead via the locking mechanism.

15. The method of claim 14, wherein rotating the inner body relative to the outer body causes the first threaded ring to move farther down along the second threaded ring via engagement of threads on the first and second threaded rings.

16. The method of claim 14, wherein rotating the inner body relative to the outer body activates a seal between the inner body and a lower sub coupled to a lower end of the outer body.

17. The method of claim 11, wherein the first threaded ring is integrally formed with the inner body.

18. The method of claim 11, wherein the first threaded ring comprises a ring that is separate from the inner body and attached to the outer circumference of the inner body via engagement of teeth.

19. The method of claim 18, further comprising maintaining the first threaded ring in a consistent orientation with respect to the inner body via one or more longitudinal protrusions extending in an axial direction from the first threaded ring that are received into corresponding slots formed into the outer circumference of the inner body.

20. The method of claim 10, further comprising disengaging the ITBC from the subsea wellhead, wherein disengaging the ITBC from the subsea well head comprises rotating the inner riser to disengage the locking mechanism.

* * * * *